US009121634B2

(12) United States Patent
Rogers et al.

(10) Patent No.: US 9,121,634 B2
(45) Date of Patent: Sep. 1, 2015

(54) CONTROLLED ATMOSPHERE SYSTEMS AND METHODS

(75) Inventors: Mark S. Rogers, Hastings, NY (US); Raymond L. Senf, Jr., Central Square, NY (US); Gilbert B. Hofsdal, Chittenango, NY (US)

(73) Assignee: CARRIER CORPORATION, Farmington, CT (US)

( * ) Notice: Subject to any disclaimer, the term of this patent is extended or adjusted under 35 U.S.C. 154(b) by 386 days.

(21) Appl. No.: 13/638,123

(22) PCT Filed: Apr. 7, 2011

(86) PCT No.: PCT/US2011/031520

§ 371 (c)(1), (2), (4) Date: Sep. 28, 2012

(87) PCT Pub. No.: WO2011/130087

PCT Pub. Date: Oct. 20, 2011

(65) Prior Publication Data

US 2013/0019961 A1 Jan. 24, 2013

Related U.S. Application Data

(60) Provisional application No. 61/323,477, filed on Apr. 13, 2010.

(51) Int. Cl.

| | |
|---|---|
| ***F24F 3/16*** | (2006.01) |
| ***F25D 17/04*** | (2006.01) |
| ***F24F 11/00*** | (2006.01) |

(52) U.S. Cl.

CPC ..... *F25D 17/042* (2013.01); *F24F 11/0009* (2013.01); *F24F 2003/1692* (2013.01); *Y10T 137/6416* (2015.04)

(58) Field of Classification Search

CPC ..... F25D 17/042; F25B 49/022
USPC ..... 62/78, 186, 228.1, 498
See application file for complete search history.

(56) References Cited

U.S. PATENT DOCUMENTS

| | | | | |
|---|---|---|---|---|
| 4,164,172 | A | | 8/1979 | Anderten et al. |
| 5,120,329 | A | * | 6/1992 | Sauer et al. ..... 95/8 |
| 5,332,547 | A | * | 7/1994 | Olson et al. ..... 422/3 |
| 5,438,841 | A | | 8/1995 | Cahill-O'Brien et al. |
| 5,457,963 | A | | 10/1995 | Cahill-O'Brien et al. |

(Continued)

FOREIGN PATENT DOCUMENTS

| | | | |
|---|---|---|---|
| CN | 1048949 | C | 1/1991 |
| DE | 4120334 | A1 | 12/1992 |
| EP | 0226107 | A1 | 6/1987 |
| EP | 0778354 | A1 | 6/1997 |
| WO | 9015546 | A1 | 12/1990 |

OTHER PUBLICATIONS

International Search Report and Written Opinion mailed Dec. 2, 2011.

(Continued)

*Primary Examiner* — Melvin Jones
(74) *Attorney, Agent, or Firm* — Cantor Colburn LLP

(57) ABSTRACT

Embodiments of controlled atmosphere systems, apparatus, and methods for the same can include systems and/or methods that can include provisions for adaptive control of compressor discharge pressure. In one embodiment, variable membrane temperature can regulate compressor discharge pressure.

20 Claims, 7 Drawing Sheets

(56) References Cited

U.S. PATENT DOCUMENTS

| | | | | |
|---|---|---|---|---|
| 5,649,995 | A * | 7/1997 | Gast, Jr. | 95/12 |
| 5,649,996 | A | 7/1997 | Soffer et al. | |
| 5,829,272 | A | 11/1998 | Barry | |
| 5,872,721 | A | 2/1999 | Huston et al. | |
| 6,085,549 | A | 7/2000 | Daus et al. | |
| 2007/0101759 | A1 | 5/2007 | Matsuoka et al. | |

OTHER PUBLICATIONS

PCT International Preliminary Report on Patentability and Written Opinion of the International Searching Authority for International Application No. PCT/US2011/031520, Apr. 7, 2011, 8 pages.

Chinese First Office Action for application 201180018752.5, dated Jul. 3, 2014, 9 pages.

* cited by examiner

CONTROLLED ATMOSPHERE SYSTEMS AND METHODS

CROSS-REFERENCE TO RELATED APPLICATION

This application claims priority to U.S. Provisional Patent Application Ser. No. 61/323,477 entitled "Controlled Atmosphere Systems and Methods" filed on Apr. 13, 2010, the content of which is incorporated herein by reference in its entirety.

FIELD OF THE INVENTION

This disclosure relates generally to controlled atmosphere systems and, more specifically, to methods and apparatus for a controlled atmosphere system for transport refrigeration units and combinations thereof.

BACKGROUND OF THE INVENTION

A particular difficulty of transporting perishable items is that such items must be maintained within a temperature range to reduce or prevent, depending on the items, spoilage, or conversely damage from freezing. A transport refrigeration unit is used to maintain proper temperatures within a transport cargo space. The transport refrigeration unit can be under the direction of a controller to generate and/or maintain a selected environment (e.g., thermal environment) within the transport cargo space. A controlled atmosphere system for a transport refrigeration system can control atmospheric composition; for example, within the transport cargo space.

SUMMARY OF THE INVENTION

In view of the background, it is an aspect of the application to provide a controlled atmosphere system and methods of operating same that can maintain cargo quality by selectively controlling components of the controlled atmosphere system.

One embodiment, according to the application can include a controller for controlling the controlled atmosphere system or a component thereof based on at least atmospheric composition conditions.

One embodiment, according to the application can include a controlled atmosphere system and/or process to control atmospheric composition such as an amount of nitrogen, carbon dioxide, and/or oxygen. One embodiment, according to the application can include a process for controlling atmospheric composition during a cooling cycle in a refrigeration system having a refrigerant compressor, a refrigerant heat rejection heat exchanger, a refrigerant heat absorption heat exchanger, and a controller.

One embodiment, according to the application can include a controller for controlling controlled atmosphere system components to regulate air compressor outlet pressure.

One embodiment, according to the application can include a controller for controlling nitrogen separation membrane temperature to generate a selected compressor discharge pressure.

In an aspect of the application, a transport refrigeration system can include a transport refrigeration system comprising a controlled atmosphere system to output a controlled atmosphere, the controlled atmosphere system comprising an air compressor to output compressed air, a heater to heat the compressed air output by the compressor, a nonelectric separator to divide the heated air into separate streams comprising its principal constituents of oxygen and nitrogen, and a controller coupled to the compressor, the heater, and the nonelectric separator to regulate temperature of the nonelectric separator to control a discharge pressure of the compressor.

In an aspect of the application, a transport refrigeration unit can include a transport refrigeration system comprising a controlled atmosphere system to output a controlled atmosphere, where the controlled atmosphere system comprises, a compressor to output compressed air, a heater to heat the compressed output by the compressor, membrane separating means for dividing the heated air into separate streams comprising its principal constituents of oxygen and nitrogen, and controlling means for regulating temperature of the membrane separating means for controlling a discharge pressure of the compressor.

In an aspect of the application, a method of operating a controlled atmosphere system can include a controlled atmosphere system for a transport refrigeration system, the method comprising operating a compressor to output compressed fluid; controllably heating the compressed fluid to a prescribed temperature; separating the heated compressed fluid into separate stream including nitrogen using a membrane separator; controllably setting an discharge fluid flow rate for the separate stream including nitrogen; and regulating temperature and pressure of the membrane separator to control a discharge pressure of the compressor.

BRIEF DESCRIPTION OF THE DRAWINGS

For a further understanding of the invention, reference will be made to the following detailed description of the invention which is to be read in connection with the accompanying drawing, wherein.

DESCRIPTION OF EXEMPLARY EMBODIMENTS

Figure 1:
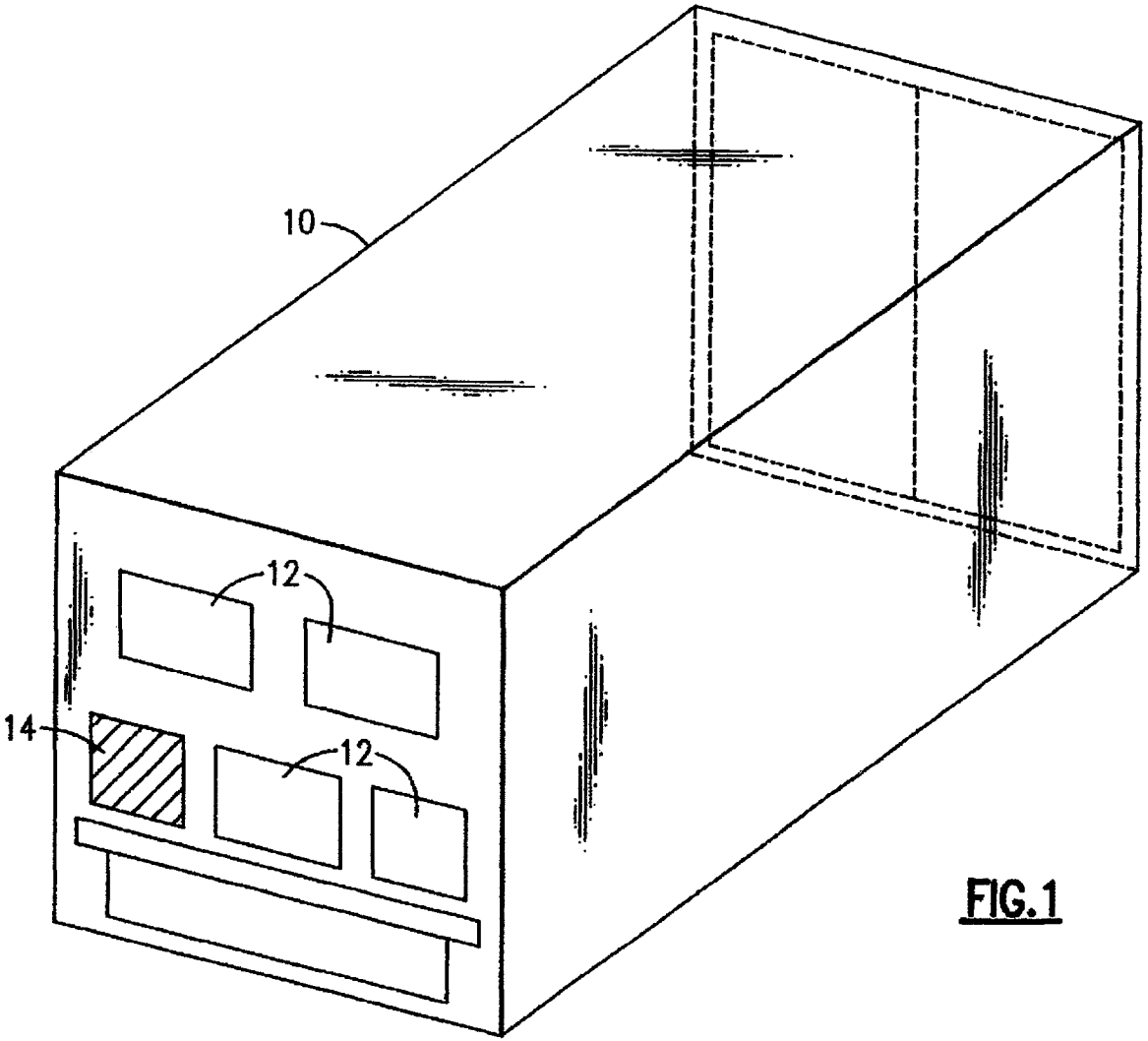
FIG. 1 is a perspective view of an exemplary refrigerated transport container for use with embodiments according to the application.

Reference will now be made in detail to exemplary embodiments of the application, examples of which are illustrated in the accompanying drawings. Whenever possible, the same reference numerals will be used throughout the drawings to refer to the same or like parts.

FIG. 1 is a diagram that shows an exemplary refrigerated container 10 that has associated therewith an integrated electrically operated transport refrigeration system 12, comprising several components, and a controlled atmosphere system, a part of which 14 is shown. The transport refrigeration system 12 and the controlled atmosphere system can be mounted at one end of the container and adapted to regulate the temperature, and the atmosphere, respectively within the container 10 (e.g., cargo in an enclosed volume). For example, the controlled atmosphere system can be included in (or separate from) the transport refrigeration system 12.

In FIG. 1, the refrigeration system 12 is integral at one end of the container 10. Alternatively, the refrigeration system 12 can be detachably coupled to the end, a side, or more than one side of the container 10. In one embodiment, a plurality of refrigeration systems can be coupled to a single container 10. Alternatively, a single refrigeration system 12 can be coupled to a plurality of containers 10. The refrigeration system 12 can operate to induct air at a first temperature and to exhaust air at a second temperature. In one embodiment, the exhaust air from the refrigeration system 12 will be warmer than the inducted air such that the refrigeration system 12 is employed to warm the air in the container 10. In one embodiment, the exhaust air from the refrigeration system 12 will be cooler than the inducted air such that the refrigeration system 12 is employed to cool the air in the container 10. The refrigeration system 12 can induct air from the container 10 having a return temperature Tr (e.g., first temperature) and exhaust air to the container 10 having a supply temperature Ts (e.g., second temperature). In one embodiment, the refrigeration system 12 can include one or more sensors (wired or wireless) to continuously or repeatedly monitor conditions or operations for the refrigeration system 12 such as a first temperature sensor for the supply temperature Ts and a second temperature sensor for the return temperature Tr.

Figure 2:
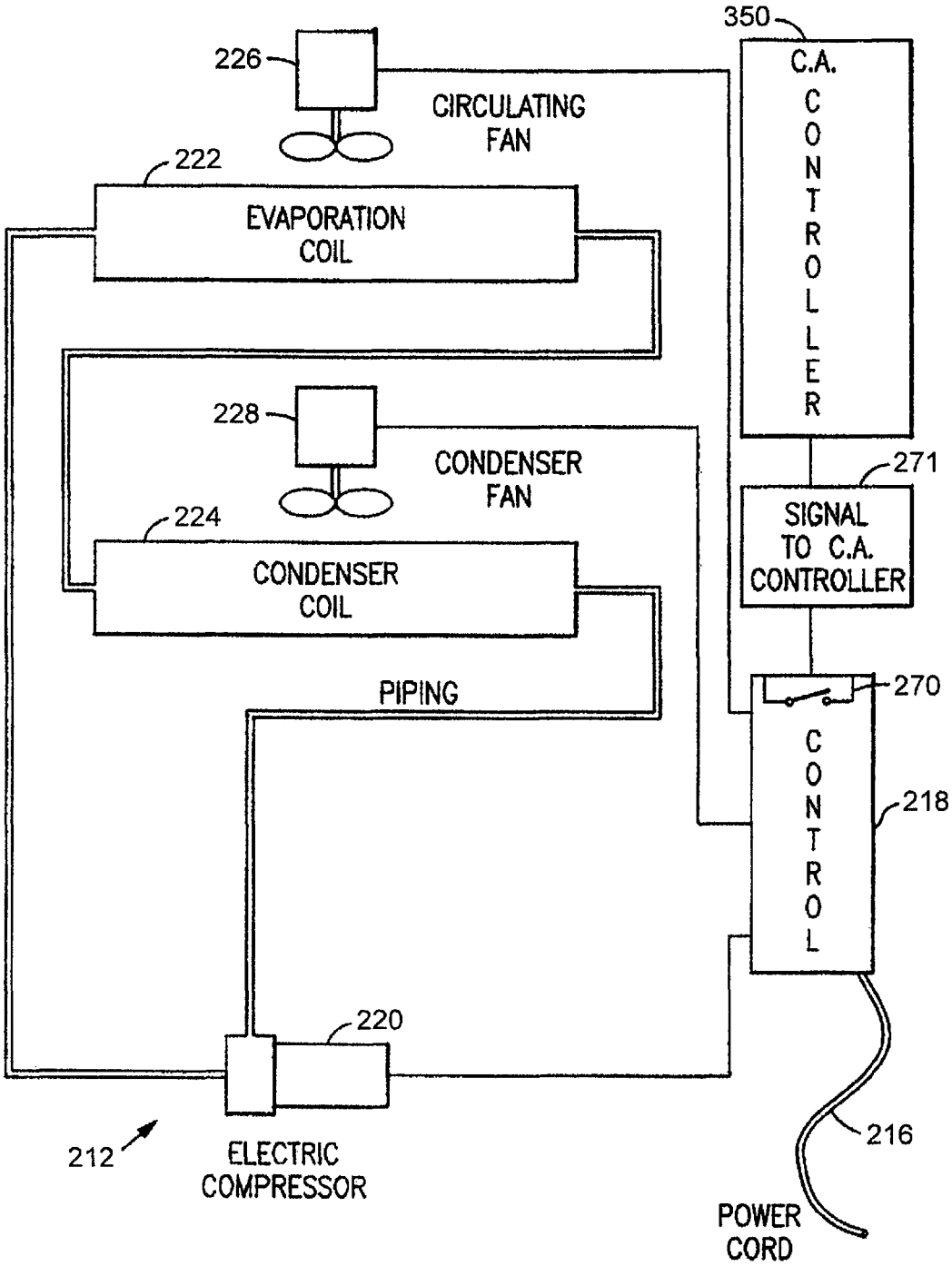
FIG. 2 is a schematic representation showing an exemplary transport refrigeration unit for use with embodiments according to the application.

With reference to FIG. 2, an exemplary refrigeration system 212 can include a vapor compression refrigeration system that is well known in the prior art for such application. Briefly, the system can receive electrical power (e.g., electrical power cord 216), providing electrical power to a refrigeration system controller 218. The controller 218 can be a programmed microprocessor that is adapted to receive inputs from the system operator and from various sensors in the refrigeration system and thereby control operations of the refrigeration system components, in a manner that is well known in the art. The refrigeration system comprises a refrigeration circuit including an electrically driven compressor 220 communicating in turn with a heat absorption heat exchanger 222 such as an evaporator coil and a heat rejection heat exchanger 224 such as a condenser coil. Appropriate fans 226 can be provided to re-circulate the atmosphere within the container 10 over the heat absorption heat exchanger 222 and into the container where it is appropriately circulated and returned to the evaporator coil for further cooling, again as is conventional. Fans 228 can be provided to direct a cooling flow of atmospheric air over the heat rejection heat exchanger 224 to facilitate rejection of heat removed from the container 10. The refrigeration system controller 218 can operate the various components, to maintain a selected set point temperature within the container as is conventional.

Figure 3:
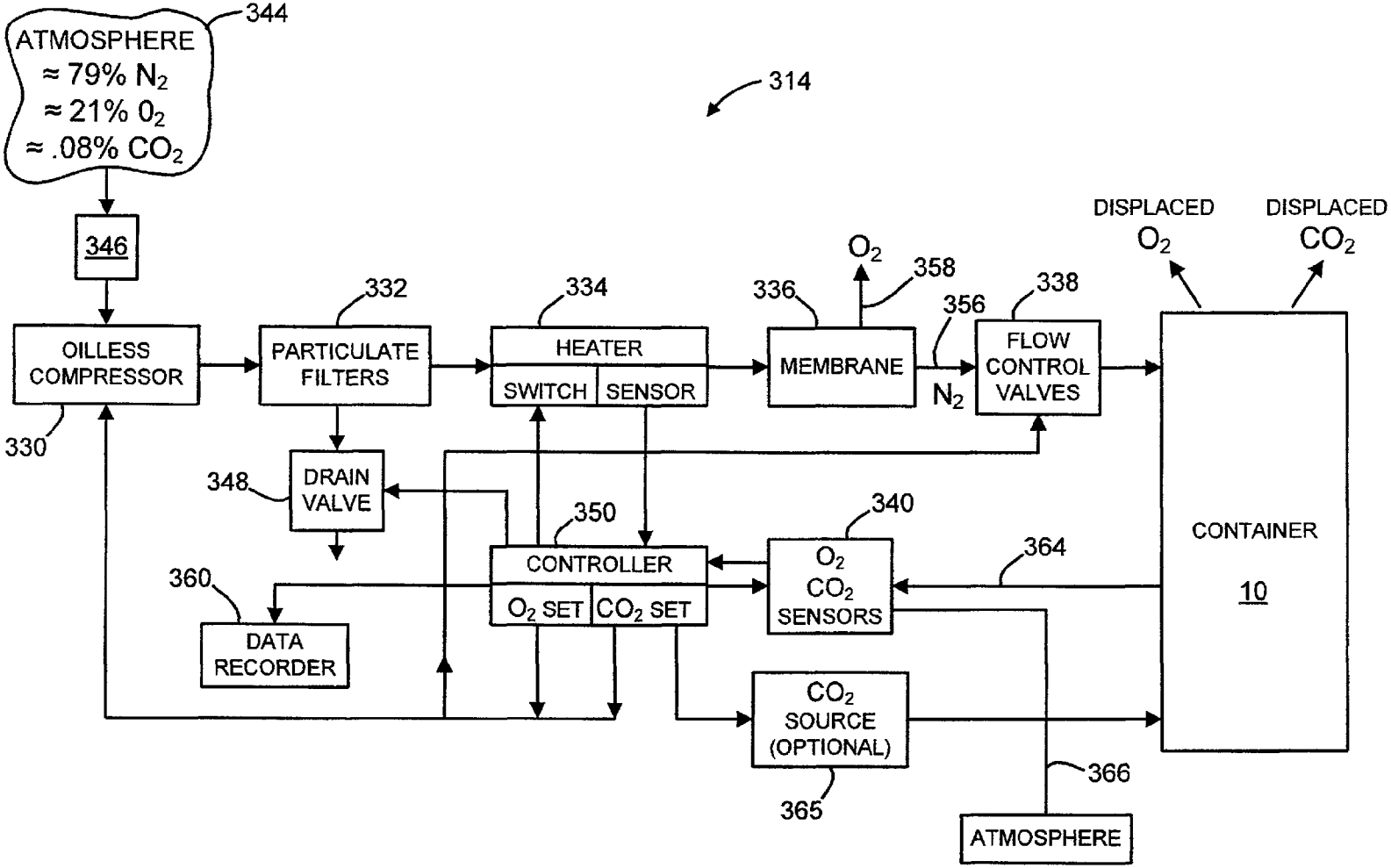
FIG. 3 is a block diagram showing an exemplary embodiment of a controlled atmosphere system according to the application.

An embodiment of a controlled atmosphere system 314 according to the application is illustrated in FIG. 3. Components of the controlled atmosphere system 314 can include a compressor 330, a filter 332, a heater 334, a nitrogen separation nitrogen separation membrane 336 (e.g., a nonelectric separator), a flow control system 338, gas sensors 340, and a controller 350.

Operations of the controlled atmosphere system can control the amount of oxygen and carbon dioxide (e.g., inside the refrigerated container 10) to change the rate of ripening of produce stored in the container. The system 314 can control the amount of oxygen (e.g., $O_2$) and carbon dioxide (e.g., $CO_2$) by replacing it with nitrogen generated from the nitrogen separation membrane 336.

With reference to FIG. 3, when the controlled atmosphere system 314 is running, air 344 from outside the container enters the compressor 330 through an inlet water separator 346. The atmospheric air can then be compressed to a high pressure by the compressor 330. The high pressure air can be filtered by the particulate filter 332 to remove moisture and dirt before passing to the heater 334. A normally closed drain valve 348 is provided on the filter 332. The drain valve 348 can be opened when energized by the controlled atmosphere system controller 350. The controller 350 can operate to periodically open the drain valve 348, for a short time, to remove residue, e.g. moisture, that may build up in the filter 332.

High pressure air from the filter 332 passes to the heater 334 where it is heated to a selected operating temperature for the nitrogen separation membrane 336. The heater 334 output can be controlled by the controller 350. For example, the controlled atmosphere controller 350 can receive inputs from a temperature sensor and control energerization of a heater switch to maintain the temperature of the compressed air leaving the air heater.

The warmed, high pressure air passing from the heater 334 enters the nitrogen separation membrane 336, where it is separated into high purity nitrogen, which can pass from the nitrogen outlet 356, and oxygen/and other gases that can pass to the oxygen outlet 358. The rate of separation occurring in the nitrogen separation membrane 336 can depend on the flow of air through the membrane. This flow rate is controlled by the pressure in the nitrogen outlet 356. The higher the pressure in the nitrogen outlet 356, the higher the nitrogen purity generated, and the lower the flow rate of nitrogen. As the pressure in the nitrogen outlet 356 falls, the purity level of the nitrogen falls, and the flow rate increases. The nitrogen separation membrane 336 is capable of generating nitrogen purity levels greater than 99 percent. The nitrogen separation membrane 336 can generate nitrogen purity levels from 85% to 99.9%.

The nitrogen enriched gas passing from the nitrogen separation membrane 336 through the outlet 356 can pass to the flow control system 338 (e.g., valves). The oxygen/other gasses from the oxygen outlet 358 can be exhausted to the outside air.

The pressure on the nitrogen outlet 356 of the nitrogen separation membrane 336 can be regulated by the flow control system 338. To control the percentage of nitrogen present in the container, the controller 350 is programmed to cycle the flow control system 338 to increase or decrease the amount of nitrogen in the container as required. The controller 350 may also add $CO_2$ from an external $CO_2$ source 365 if desired.

In one embodiment, the controller 350 can monitor the amount of oxygen and carbon dioxide (e.g., in the container), using oxygen and carbon dioxide gas concentration sensors 340 via a sample line 364. Periodic calibration of the $O_2$ sensor and/or the $CO_2$ sensor to correct drifts with time and temperature can be performed, for example, by sampling outside air via line 366.

In one exemplary operation following loading of the container 10, and connection of an appropriate power source, the refrigeration system controller 218 can be energized and programmed to a desired set point temperature or temperature range for the load (e.g., in container 10). At the same time or after reaching a prescribed temperature range for the load, the controller 350 for the controlled atmosphere system can be energized and set for the desired oxygen and carbon dioxide ranges for the load.

With both the refrigeration system 212 and the controlled atmosphere system 314 energized and suitably programmed, a transport refrigeration system can begin immediate operation according to its programmed operations or selected operations. The controlled atmosphere system 314, however, will begin operation only enabled, for example, when a controlled atmosphere enable switch 270 is closed by the refrigeration system controller 218. In one embodiment, the controlled atmosphere system 314 can be enabled (e.g., by controller 218) based on operating conditions of the refrigeration system, operating conditions of the controlled atmosphere system, and/or conditions within the refrigerated container 10.

Figure 4:
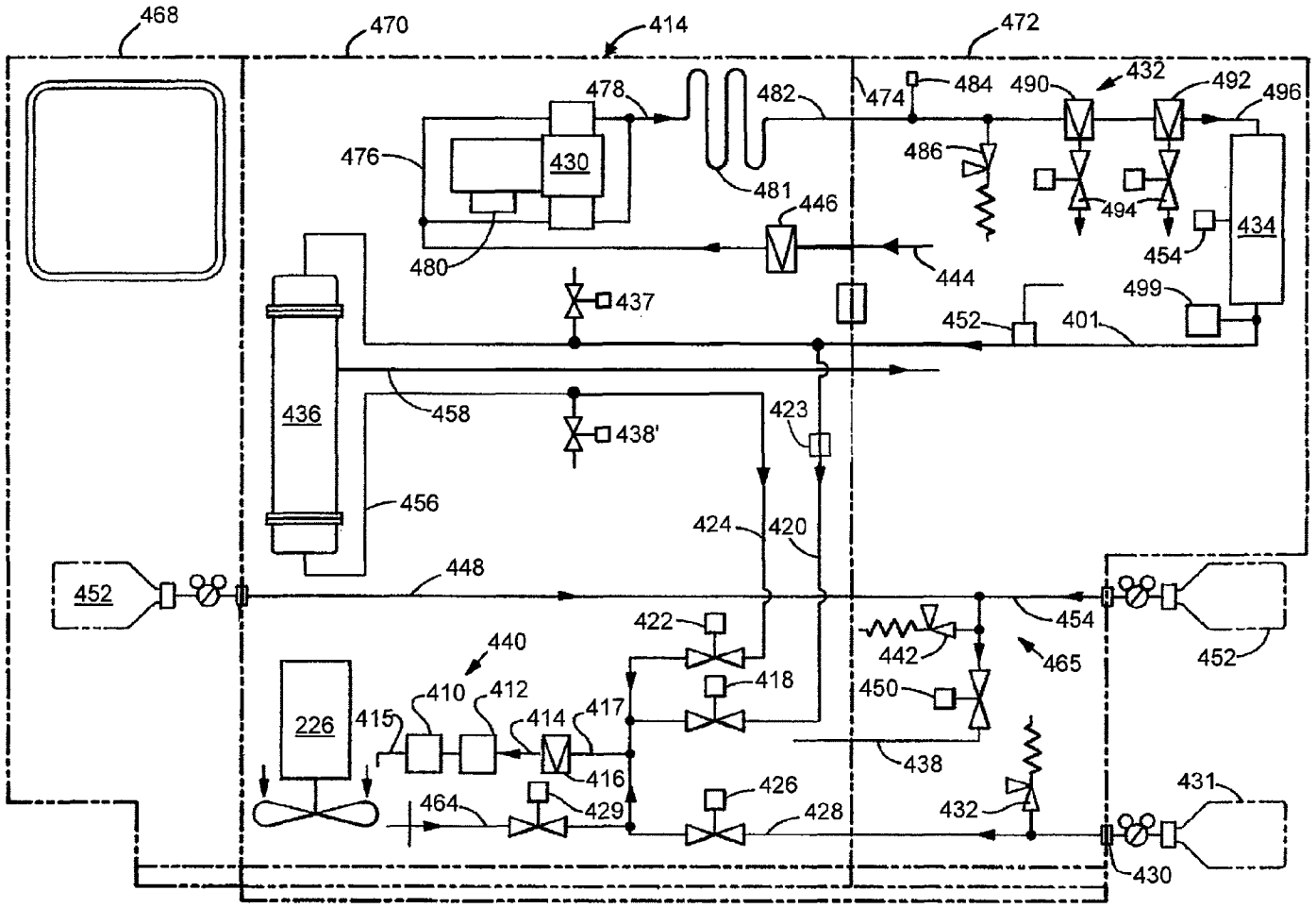
FIG. 4 is a schematic diagram of another exemplary embodiment of a controlled atmosphere system according to the application.

FIG. 4 is a diagram showing an embodiment of a controlled atmosphere system according to the application that can be operatively coupled to or installed in a container refrigeration unit. For reference purposes it should be understood that the broken lines in the schematic can be considered to delineate different parts of the refrigerated/controlled atmosphere refrigeration container unit (or components operatively coupled thereto), and thus are useful in describing exemplary non-limiting locations of various components. The enclosed portion shown by the broken line 468 on the left hand portion represents the interior of the refrigerated container box 10. The portion to the right of the interior of the box, identified by numeral 470, represents the heat absorption heat exchanger or evaporator section of the combined refrigeration/controlled atmosphere unit mounted to the end of the container. The atmosphere in the section 470 is the same as the atmosphere within the container box as the circulating fans 226 of the refrigeration system 212 can re-circulate the air between these sections. The right hand portion of the schematic as shown by the lines 472 is the heat rejection heat exchanger section or condenser section of a combined container refrigeration/controlled atmosphere unit.

The condenser section 472 is in direct contact with the normal atmosphere or the ambient environment. The section 472 and the evaporator section 470 can be separated by a substantially fluid tight barrier represented by line 474.

As shown in FIG. 4, accumulator 446 can be located in the evaporator section 470 so as to receive outside atmospheric air 444. A dust filter can be in series before the accumulator 446. An appropriate inlet conduit 476 is in fluid communication with an air compressor 430 that can have an outlet conduit 478 for high pressure compressed air discharged therefrom. Various compressors can be used for the compressor 430. An over-temperature switch 480 can be provided on the air compressor motor to direct a signal to the controlled atmosphere controller 350 should the compressor 430 reach an unsafe temperature.

The outlet conduit 478 from the compressor communicates with a tortuously shaped condensing coil or condensing line 481 that can cool the high pressure high temperature air discharged from the compressor and to condense moisture contained therein to a liquid state. From the condensing line 481, conduit 482 passes through barrier 474 into the condenser section 472. Located in the conduit 482 can be a test valve 484 to facilitate servicing of the system, as for example, conducting a pressurized leak check. Also located in conduit 482 can be a pressure relief valve 486 designed to protect the air compressor should a high back pressure develop in the system, which could damage the compressor 430.

According to embodiments of the application where compressor discharge pressure is controlled by membrane temperature and/or pressure, valves 484 and 486 are optional or can be removed.

Downstream from the pressure relief valve 486, the air filter assembly 432 can filter the high pressure air discharged from the compressor 430. In one embodiment, the filter assembly is two separate filters, a primary discharge air filter 490 for large contaminants, and a secondary discharge air filter 492 for fine particulate contaminants. Each of the filters 490 and 492 can include filter media, which is replaceable on a periodic schedule. Each filter 490, 492 can be provided with a drain solenoid valve 494. These electrically operated valves are normally closed and are adapted to be opened by the controlled atmosphere controller 350 on a periodic schedule, for a short period of time, to remove residue built up in the filters.

Conduit 496 can communicate the outlet of filter 492 with the inlet of the air heater 434. The air heater 434 can be controlled by the system controller 350 to moderate the temperature entering the membrane separator 436 within which the nitrogen separation membrane is disposed. Since the air will saturate the nitrogen separation membrane, the temperature of the nitrogen separation membrane will be the air temperature. For example, heater operation can be controlled by the system controller 350 using inputs from the desired set point temperature and from an air temperature sensor 452 that can be located in the conduit 401 that communicates the outlet of the air heater 434 with the inlet of the membrane separator 436. Air heater temperature control inputs from the controller 350 can cycle the heater on/off switch 454 located adjacent to the heater. An air heater over temperature safety switch 499 can be provided to interrupt power to the heater 434 if the temperature exceeds a predetermined safe level.

The membrane separator 436 can have an oxygen outlet 458 that can extend from the membrane separator 436 through the barrier 474 to discharge oxygen and other gases to the outside atmosphere. The nitrogen outlet 456 can operate to controllably dispense nitrogen into the section 468 and/or the section 470. However, the nitrogen outlet 456 can also extend through the barrier 474 into the condenser section 472 to communicate with the flow control system (e.g., metering valves) 438. Various gauges and/or displays can be mounted to the nitrogen outlet 456 in the condenser section 472.

The flow control system 438 can include a separate metering device to control the flow of nitrogen into the container section 468 or the evaporator section 470. In one embodiment, the nitrogen delivered by a nitrogen purity valve 438' as the flow control system 438 is then circulated by the circulating fans 226 of the refrigeration system to the interior 468 of the container box 10. An oxygen solenoid valve 437 can controllably discharge compressed air from line 401 to the evaporator section 470.

In another embodiment, the flow control system 438 can include three separate solenoid valves in parallel that operate to output increasingly pure nitrogen. Exemplary but non-limiting valve combinations are described here. With all three valves open, flow is through all three valves and the membrane will produce an output of approximately 15 percent oxygen and 85 percent nitrogen. This can be a low purity, high flow condition (e.g., a first condition). With only a first valve open, the system can produce approximately 5 percent oxygen and 95 percent nitrogen. This can be a medium purity, medium flow condition (e.g., second condition). With only a second valve open, the system will produce approximately 0.5 percent oxygen and 99.5 percent nitrogen. This can be a high purity, low flow condition (e.g., third condition). In addition, temperature control at the membrane separator 436 can be used in combinations with the flow control system 438 to controllably select a prescribed air flow rate and/or a prescribed nitrogen purity level with increase in a continuous range between 85%-<100%. In one embodiment, the system 314 or the controller 350 can use oxygen value as its primary control input. Further, in one embodiment, an operator can select or define an air fluid (e.g., air) flow rate or nitrogen purity level.

However, nitrogen level output for the first, second, and third conditions can be modified corresponding to use of the system 12 and 212 or cargo (e.g., by the controller 350). Further, a single controlled valve can be used for the flow control system 438', which can be controllably opened (or incrementally stepped), to provide the first, second, and third conditions.

Also located in the evaporator section 470 can be gas sensors 440. The sensors 440 can include an oxygen sensor 410 that can measure the concentration of oxygen, and a $CO_2$ sensor 412 that can measure the concentration of carbon dioxide inside the sample (e.g., container). For example, the oxygen sensor can be a galvanic fuel cell, and the $CO_2$ sensor can be a non-dispersive infrared (NDIR) microbench $CO_2$ sensor. The sensors 410, 412 can generate a signal, which is converted by the controller 350 to a percent $CO_2$, $CO_2$ read that can be used or displayed on a readout on a digital display. The oxygen sensor 410 and carbon dioxide sensor 412 can be in serial fluid flow relationship in a gas sampling line 414. Downstream from the sensors is a discharge line 415 open to the outside or the condenser section 472, while upstream can be a gas sample filter 416.

In one embodiment, four electrically actuated solenoid valves may be selectively actuated to provide the desired gas sample flow to the inlet line 417 to the sensors 440.

A first solenoid valve 418 is located in an air sample line 420, which is adapted to deliver a sample of the warm air from the conduit 401 of the membrane separator 436. A capillary tube or other suitable pressure drop device 423 is provided in this line as the air supply line is at high pressure.

A second solenoid valve 422 is positioned in a nitrogen sample supply line 424 that communicates with the nitrogen outlet conduit 456. A third solenoid valve 426 is located in a calibration gas delivery line 428. The calibration gas delivery line is adapted to be connected with a calibration gas tank 431, which contains a calibration gas such as but not limited to 5 percent $CO_2$ and 95 percent nitrogen. For safety purposes a pressure relief valve 432 is provided in the calibration gas line 428.

The fourth solenoid valve 429 is located in the sample line 464, which is adapted to deliver a sample of the gas within the container 10 to the gas sensors 440. Each of these exemplary solenoid valves can be selectively actuated by the controlled atmosphere system controller 350. Outputs from the $O_2$ sensor 410 and the $CO_2$ sensor 412 can be delivered to the system controller 350 (and/or system 212) to monitor the operation and performance of components of the system. Alternatively, a portion or up to all of the gas sensors 440 and a gas sample control system (e.g. four solenoid valves) can be in the condenser section 472.

With continued reference to FIG. 4 the system can be provided with a $CO_2$ supply system 465. The system includes a $CO_2$ delivery line 438, which has a normally closed electrically actuated solenoid valve 450 positioned therein. A pressure relief valve 442 is also provided in the $CO_2$ supply line 438. Exemplary locations for $CO_2$ supply bottles 452 can be outside of the entire unit or in the interior 468 of the container box using a supply line 448.

The $CO_2$ supply system 465 can be physically separate from the rest of the controlled atmosphere system and can be actuated as needed by the control atmosphere controller 350 by actuation of a solenoid valve 450. Located within the interior 468 of the container 10 can be a door safety interlock solenoid and/or an interlock mechanism that can prevent the doors of the container form being opened when the oxygen level in the container falls below a predetermined value.

Figure 5:
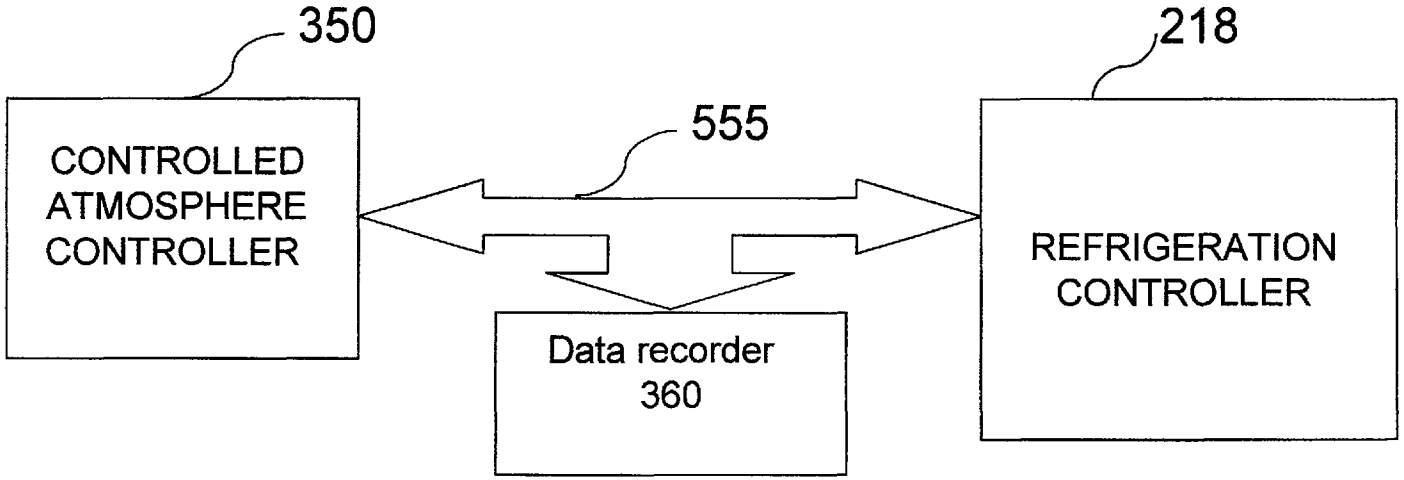
FIG. 5 is a block diagram showing one exemplary relationship between the controllers of a transport refrigeration unit and controlled atmosphere system.

In one embodiment of integrated refrigeration/controlled atmosphere systems and/or methods operating according to the application, communications can be implemented between the controller 218 of the refrigeration system and the controller 350 of the controlled atmosphere system 414. One example of such communication is the over riding control of the controlled atmosphere system 414 by the refrigeration controller 218. One relationship between the controllers 218 and 350 is shown schematically in FIG. 5 where arrows 555 interconnecting the controllers and electronic data recorder 360 are meant to illustrate the ability of these components to electronically communicate with one another. The data recorder can periodically record, for future reference, information from both the refrigeration controller and the controlled atmosphere controller. Information recorded from the refrigeration controller typically includes temperature of supply and return air being circulated. Information recorded from the controlled atmosphere controller includes $O_2$ and $CO_2$ levels.

Embodiments according to the application can provide controlled atmosphere system and/or methods capable of adaptive system compressor head pressure control to improve compressor reliability and membrane efficiency. In one embodiment, variable membrane temperature and pressure inputs can be used to regulate compressor output pressure. In contrast, related art systems use a fixed membrane temperature. Thus, the related art system pressure is dictated by the fixed membrane temperature and corresponding membrane efficiency and membrane variability.

In one embodiment using the system 414, the controller 350 can vary the air temperature entering the membrane separator 436, and therefore the temperature of the nitrogen separation membrane, to regulate discharge pressure of the compressor 430 to a prescribed level or selected level, which can be determined by compressor reliability studies. After the nitrogen level for the cargo is determined or provided to the controller 350, the controller 350 can set the corresponding membrane temperature and pressure within an acceptable range of values to improve compressor performance. For example, the controller 350 can select a desired compressor 430 performance level within a controllable range of compressor 430 performance levels by varying the membrane temperature and/or pressure. In one embodiment, compressor reliability can empirically determine a selected desired compressor discharge pressure level. Improved compressor reliability can provide increased nitrogen flow and more consistent system performance throughout the compressor 430 life cycle.

In one embodiment, the air temperature entering the membrane separator 436 is varied to regulate compressor discharge pressure to a selected or prescribed level. The selected level can be determined by nitrogen purity requirement and compressor reliability. Further, embodiments can increase membrane efficiency because changes in membrane characteristics caused by membrane aging can be automatically (e.g., continuously) compensated. For example, effects to the system from membrane efficiency and resistance changes can now be compensated for by adaptive logic with membrane control.

Figure 6:
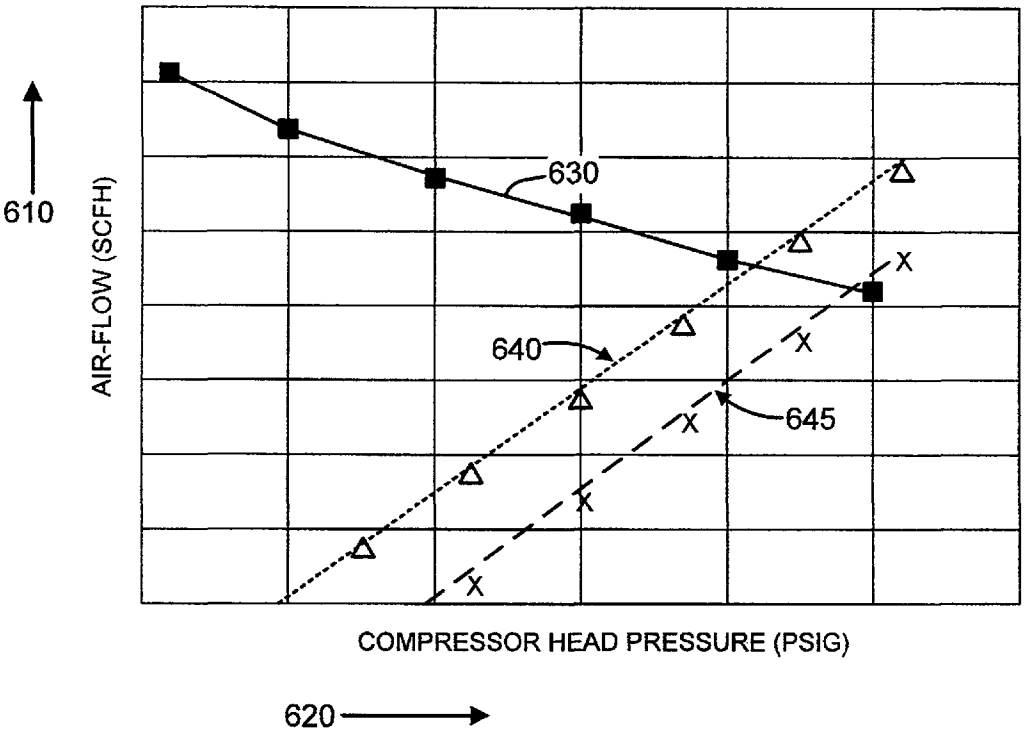
FIG. 6 is a diagram showing exemplary relationships between system parameters during operations of an exemplary controlled atmosphere system according to embodiments of the application.

FIG. 6 is a diagram that illustrates exemplary relationships showing exemplary adaptive compressor head pressure control (e.g., membrane control of compressor discharge performance) according to embodiments of the application. As shown in FIG. 6, exemplary relationships exist between the nitrogen purity level; membrane temperature, membrane pressure or air flow rate; and compressor discharge performance. As shown in FIG. 6, air flow (e.g., compressed air flow) from the compressor is increasing on the air flow axis 610. One exemplary measurement for air flow can be Standard Cubic Feet of air per Minute (SCFM). In FIG. 6, compressor head pressure of the compressor is increasing on the pressure axis 620. One exemplary measurement for the compressor head pressure is pound-force per square inch gauge (PSIG), which is a unit of pressure relative to atmospheric pressure at sea level. As shown in FIG. 6, an exemplary compressor performance line 630 shows that as compressor head pressure increases in the controlled atmosphere system 414, air flow from the compressor 430 and/or through the membrane 436 decreases.

Curves 640, 645 show exemplary identical nitrogen purity output relationships (e.g., 90% nitrogen, 95% nitrogen, 99% nitrogen, 99.99% nitrogen) at different temperatures of the membrane 336 or different heated air temperatures. As shown in FIG. 6, the curve 640 is at a higher temperature than the curve 645. In one embodiment, by moving between or selecting among a family of curves 640, 645 (or curve at temperatures therebetween), adaptive compressor control can be implemented.

An embodiment of a method of operating a transport refrigeration system according to the application will now be described. The method embodiment shown in FIG. 7, can be implemented in and will be described using the controlled atmosphere system embodiment shown in FIG. 4, however, the method embodiment is not intended to be limited thereby.

Figure 7:
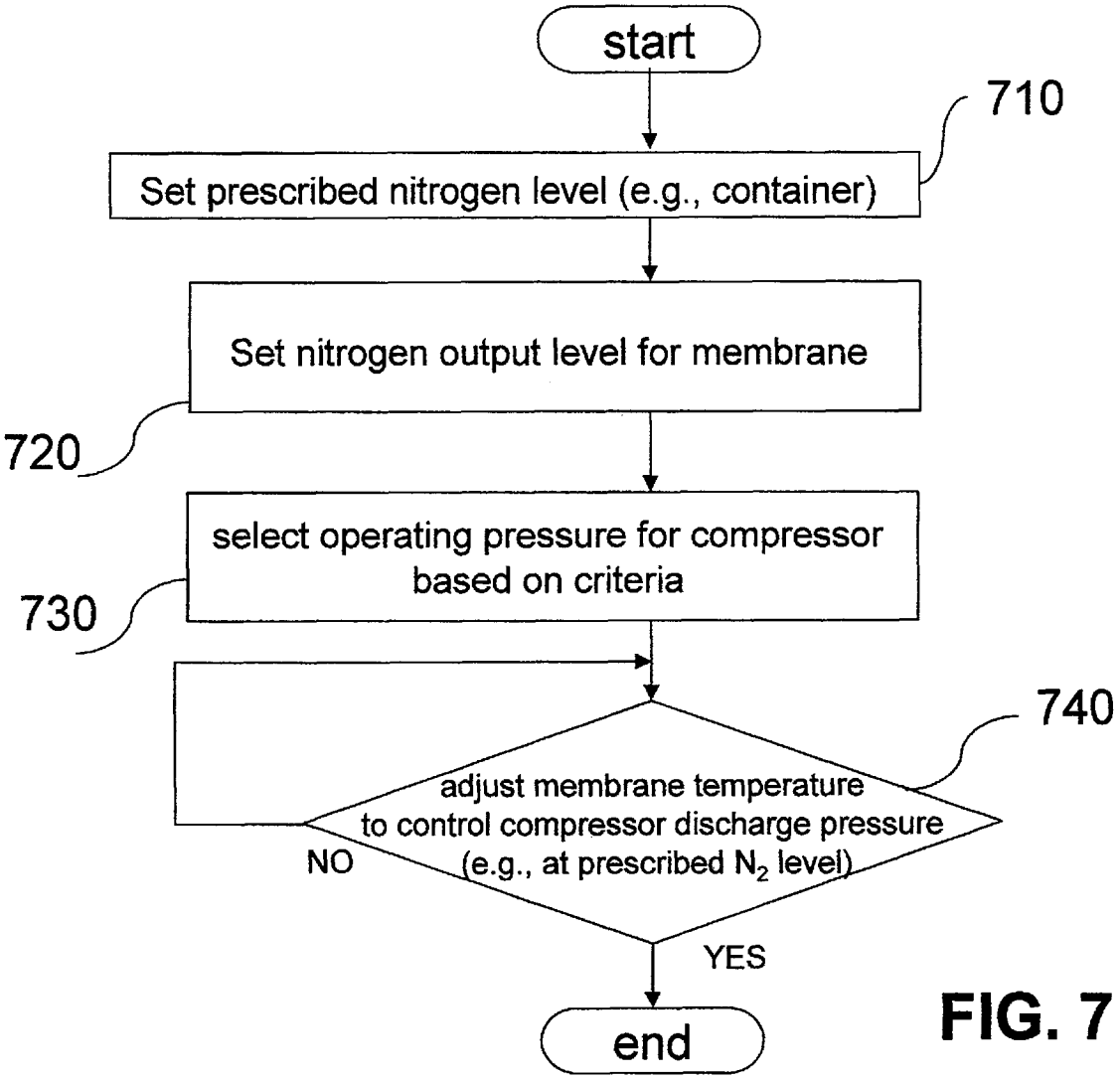
FIG. 7 is a diagram showing a flow chart illustrating an exemplary embodiment of a process for controlling compressor pressure during operations of controlled atmosphere system according to the application.

As shown in FIG. 7, after a process starts, after the controlled atmosphere system 314 is enabled, it can be provided a prescribed nitrogen level, which can be the desired level of nitrogen in the container (operation block 710). By setting the nitrogen level (i) for output to or (ii) for cargo in the container, the oxygen and carbon dioxide levels can be determined and controlled (e.g., by controller 350). In operation block 710, a transport refrigeration system 12 or the controller 218 can be concurrently operated.

Once the nitrogen level for the system is received or set, the controller 350 can determine a nitrogen output level for the membrane 436 or the controlled atmosphere system 414 (operation block 720). In one embodiment, the controlled atmosphere system 414 can set the temperature for the membrane and control the flow rate from the nitrogen outlet 456 and (e.g., using the nitrogen purity valve 438') in operation block 720. For example, the controller 350 set a lower purity nitrogen level with its relatively higher air flow rate to introduce more nitrogen (e.g., raise a nitrogen level) into the container. Alternatively, the controller 350 can set a higher purity nitrogen level with its relatively lower air flow rate to raise a nitrogen level in the container. In one embodiment, the nitrogen purity level can be selected anywhere in a continuous range or discrete range of values. In one embodiment, three conditions (or more) for the nitrogen purity valve 438' can be used. In one embodiment, low purity, high flow condition; medium purity, medium flow condition or high purity, low flow condition (e.g., first, second, third conditions) can be used. However, embodiments are not intended to be limited as the nitrogen purity level and/or air flow rate into the container may be controlled using other components or additional components of the controlled atmosphere system 414.

Once the nitrogen output level is set for the membrane 436, the discharge pressure of the compressor can be adaptively controlled (e.g., to operate at an optimal or selected pressure) using the compressor reliability data and the family of temperature curves (e.g., curves 630, 645) for the nitrogen output level (operation block 730).

Then, the membrane temperature and/or pressure can be monitored and modified to control or maintain the compressor discharge pressure at the selected level (operation block 740). For example, as the membrane operating characteristics change over time, the change can be automatically compensated for in operation block 740. From operation block 740, the process can end.

In one embodiment, the flow chart of FIG. 7 or condition(s) in operations blocks 730-740 can be performed periodically, repeatedly, continuously, upon operator action or responsive to sensed criteria.

In one embodiment, reliability of the compressor 430 was empirically tested and increased a lower discharge pressure. Further, an operational lifetime of the compressor 430 was shown to increase at lower discharge pressures. In one embodiment, compressor discharge can be maintained within a prescribed range. In one embodiment, controlling compressor discharge pressure using membrane pressure and/or membrane temperature decreased or prevented efficiency loss by spring loaded pressure regulator devices (e.g., pressure relief valves) in the controlled atmosphere system.

Embodiments and methods according to the application can provide improved adaptive compressor discharge pressure control using membrane pressure and/or membrane temperature. Adaptive compressor discharge pressure control can include nitrogen output levels and/or controlled atmosphere system output flow rates (e.g., valve 438').

Refrigerant vapor compression systems are commonly used for conditioning air to be supplied to a climate controlled comfort zone within a residence, office building, hospital, school, restaurant, or other facility. Refrigerant vapor compression system are also commonly used for refrigerating air supplied to display cases, merchandisers, freezer cabinets, cold rooms or other perishable/frozen product storage areas in commercial establishments. Refrigerant vapor compression systems are also commonly used in transport refrigeration systems for refrigerating air supplied to a temperature controlled cargo space of a truck, trailer, container, or the like for transporting perishable/frozen items by truck, rail, ship, or intermodal.

Containers described herein can be towed by a semi-truck or integral with a truck for road transport. However, those having ordinary skill in the art will appreciate that exemplary containers according to embodiments of the application is not limited to such trailers and may encompass, by way of example only and not by way of limitation, intermodal containers, trailers adapted for piggy-back use, railroad cars, and container bodies contemplated for land and sea service, used for the transportation or storage of goods requiring a temperature controlled environment, such as, for example foodstuffs and medicines (e.g., perishable or frozen). The container can include an enclosed volume for the transport/storage of such goods. The enclosed volume may be an enclosed space having an interior atmosphere isolated from the outside (e.g., ambient atmosphere or conditions) of the container.

Transport refrigeration system can provide air with controlled temperature, humidity or/and species concentration into an enclosed chamber where cargo is stored such as in container 10. As known to one skilled in the art, the transport refrigeration system (e.g., controller) can control a plurality of the environmental parameters or all the environmental parameters within corresponding ranges with a great deal of variety of cargos and under all types of ambient conditions.

In one embodiment, the flow chart of FIG. 7 can be implemented in a software program residing in the microprocessor of the controlled atmosphere controller or system 12 for operation during transport refrigeration system operations.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been set forth, it will be understood that features and aspects that have been described with reference to each particular embodiment can be used with each remaining particularly set forth embodiment. For example, aspects and/or features of embodiments described with respect to FIG. 4 can be combined with aspects or features of embodiments described with respect to FIG. 6 or FIG. 7.

We claim:

1. A controlled atmosphere system to output a controlled atmosphere, the controlled atmosphere system comprising:

an air compressor to output compressed air, a heater to heat the compressed air output by the compressor, a nonelectric separator to divide the heated air into separate streams comprising its principal constituents of oxygen and nitrogen, and a controller coupled to the compressor, the heater, and the nonelectric separator to regulate temperature of the nonelectric separator to control a discharge pressure of the compressor;

wherein the controller sets a nitrogen output for the nonelectric separator, sets a discharge pressure for the compressor in response to the nitrogen output and controls at least one of pressure and temperature of the nonelectric separator to maintain the discharge pressure of the compressor.

2. A controlled atmosphere system to output a controlled atmosphere, the controlled atmosphere system comprising:

an air compressor to output compressed air, a heater to heat the compressed air output by the compressor, a nonelectric separator to divide the heated air into separate streams comprising its principal constituents of oxygen and nitrogen, and a controller coupled to the compressor, the heater, and the nonelectric separator to regulate temperature of the nonelectric separator to control a discharge pressure of the compressor;

wherein the selected discharge pressure of the compressor is selected to increase compressor lifetime or to reduce compressor discharge pressure.

3. The controlled atmosphere system of claim 1, the controlled atmosphere system to maintain a prescribed nitrogen concentration in air output by the nonelectric separator.

4. The controlled atmosphere system of claim 3, wherein the prescribed nitrogen concentration is 90%-99.95% nitrogen, or wherein the prescribed nitrogen level is 95%, 99% or 99.9% nitrogen.

5. A controlled atmosphere system to output a controlled atmosphere, the controlled atmosphere system comprising:

an air compressor to output compressed air, a heater to heat the compressed air output by the compressor, a nonelectric separator to divide the heated air into separate streams comprising its principal constituents of oxygen and nitrogen, and a controller coupled to the compressor, the heater, and the nonelectric separator to regulate temperature of the nonelectric separator to control a discharge pressure of the compressor;

wherein the nonelectric separator comprises a gas separating membrane, and wherein the temperature of the nonelectric separator decreases as the gas separating membrane ages.

6. A controlled atmosphere system to output a controlled atmosphere, the controlled atmosphere system comprising:

an air compressor to output compressed air, a heater to heat the compressed air output by the compressor, a nonelectric separator to divide the heated air into separate streams comprising its principal constituents of oxygen and nitrogen, and a controller coupled to the compressor, the heater, and the nonelectric separator to regulate temperature of the nonelectric separator to control a discharge pressure of the compressor;

wherein an inlet pressure of the nonelectric separator is also the discharge pressure of the compressor.

7. The controlled atmosphere system of claim 1, the controller to operate the controlled atmosphere system to output an increased amount of nitrogen.

8. The controlled atmosphere system of claim 7, the controller to operate in a first mode having a first air flow rate through the nonelectric separator and a first concentration of nitrogen output by the nonelectric separator, or a second mode having a lower second air flow rate through the nonelectric separator and a higher second concentration of nitrogen output by the nonelectric separator.

9. The controlled atmosphere system of claim 8, the controller to operate in a third mode having operating conditions between the first mode and the second mode.

10. The controlled atmosphere system of claim 1, further comprising a refrigeration system including a refrigerant compressor, a heat rejection heat exchanger, and a heat absorption heat exchanger in a refrigerant cycle, the refrigeration system comprising a controller to control operation of said controlled atmosphere system, said controlled atmosphere system controller to control said controlled atmosphere system when enabled by the refrigeration system.

11. The controlled atmosphere system of claim 10, wherein said refrigeration system and said controlled atmosphere system are both powered from the same source of electrical power, and coupled to control a temperature and an atmosphere of a confined space.

12. A controlled atmosphere system to output a controlled atmosphere, the controlled atmosphere system comprising:

an air compressor to output compressed air, a heater to heat the compressed air output by the compressor, a nonelectric separator to divide the heated air into separate streams comprising its principal constituents of oxygen and nitrogen, and a controller coupled to the compressor, the heater, and the nonelectric separator to regulate temperature of the nonelectric separator to control a discharge pressure of the compressor;

wherein a selected discharge pressure of the compressor is determined by compressor reliability, wherein the system operates on fluids other than air.

13. The controlled atmosphere system of claim 1 wherein the temperature of the nonelectric separator is controlled to maintain the discharge pressure of the compressor within a prescribed discharge pressure range.

14. The controlled atmosphere system of claim 1 wherein the separate stream including nitrogen is within a prescribed nitrogen purity range.

15. The controlled atmosphere system of claim 1 wherein the controlled atmosphere is output to an enclosed volume of a refrigerated transport container.

16. A transport refrigeration system comprising:

a controlled atmosphere system to output a controlled atmosphere, where the controlled atmosphere system comprises, a compressor to output compressed air, a heater to heat the compressed output by the compressor, membrane separating means for dividing the heated air into separate streams comprising its principal constituents of oxygen and nitrogen, and controlling means for regulating temperature of the membrane separating means for controlling a discharge pressure of the compressor;

wherein the controlling means sets a nitrogen output for the membrane separating means, sets a discharge pressure for the compressor in response to the nitrogen output and controls at least one of pressure and temperature of the membrane separating means to maintain the discharge pressure of the compressor.

17. The transport refrigeration system of claim 16, said controlling means is coupled to the compressor, the heater, and said membrane separating means, said controlling means for regulating pressure of the membrane separating means for controlling a discharge pressure of the compressor.

18. A method of operating a controlled atmosphere system for outputting a controlled atmosphere, the method comprising:

operating a compressor to output compressed fluid;

controllably heating the compressed fluid to a prescribed temperature;

separating the heated compressed fluid into separate stream including nitrogen using a membrane separator;

controllably setting an discharge fluid flow rate for the separate stream including nitrogen; and regulating temperature of the membrane separator to control a discharge pressure of the compressor;

wherein regulating temperature of the membrane separator comprises setting a nitrogen output for the membrane separator, setting a discharge pressure for the compressor in response to the nitrogen output and controlling temperature of the membrane separator to maintain the discharge pressure of the compressor.

19. The method of claim 18, comprising:

selecting a nitrogen level of the separate stream including nitrogen.

20. A method of operating a controlled atmosphere system for outputting a controlled atmosphere, the method comprising:

operating a compressor to output compressed fluid;

controllably heating the compressed fluid to a prescribed temperature;

separating the heated compressed fluid into separate stream including nitrogen using a membrane separator;

controllably setting an discharge fluid flow rate for the separate stream including nitrogen; and regulating temperature of the membrane separator to control a discharge pressure of the compressor;

wherein an inlet pressure of the membrane separator is also the discharge pressure of the compressor.

* * * * *